US011747021B2

(12) United States Patent
Miao et al.

(10) Patent No.: US 11,747,021 B2
(45) Date of Patent: Sep. 5, 2023

(54) GAS COOKTOP

(71) Applicant: BSH Hausgeräte GmbH, Munich (DE)

(72) Inventors: Weiwei Miao, Nanjing (CN); Rui Xu, Nanjing (CN); Weihong Zhu, Nanjing (CN)

(73) Assignee: BSH Hausgeräte GmbH, Munich (DE)

( * ) Notice: Subject to any disclaimer, the term of this patent is extended or adjusted under 35 U.S.C. 154(b) by 67 days.

(21) Appl. No.: 16/772,261

(22) PCT Filed: Nov. 26, 2018

(86) PCT No.: PCT/IB2018/059295
§ 371 (c)(1),
(2) Date: Jun. 12, 2020

(87) PCT Pub. No.: WO2019/130129
PCT Pub. Date: Jul. 4, 2019

(65) Prior Publication Data

US 2021/0088220 A1 Mar. 25, 2021

(30) Foreign Application Priority Data

Dec. 27, 2017 (CN) ..... 201711454100.1

(51) Int. Cl.
*F24C 3/12* (2006.01)
*F23N 1/00* (2006.01)

(52) U.S. Cl.
CPC ..... *F24C 3/126* (2013.01); *F23N 1/005* (2013.01); *F23D 2208/10* (2013.01);
(Continued)

(58) Field of Classification Search
CPC ..... F24C 3/122; F24C 3/008; F24C 3/027; F24C 3/085; F24C 3/12; F24C 3/126;
(Continued)

(56) References Cited

U.S. PATENT DOCUMENTS 5,628,242 A * 5/1997 Higley ..... A47J 37/0713 126/25 R
9,599,345 B2 * 3/2017 McAfee ..... F24C 3/126
(Continued)

FOREIGN PATENT DOCUMENTS

CN 106369639 A * 2/2017 ..... F24C 3/126
DE 102005041574 A1 4/2006
(Continued)

OTHER PUBLICATIONS

Machine Translation of Peng (Year: 2017).*
International Search Report PCT/IB2018/059295 dated Jan. 28, 2019.

*Primary Examiner* — Jason Lau
(74) *Attorney, Agent, or Firm* — Michael E. Tschupp; Brandon G. Braun; Andre Pallapies

(57) ABSTRACT

A gas cooktop includes a cooktop body having a burner head which when activated generates a fire for heating cookware placed on the burner head, and a control system which includes a fire detection apparatus installed over the burner head and is aligned with the burner head. The control system further includes a control apparatus receiving a signal of the fire detection apparatus to control the fire of the burner head. The control apparatus determines, depending on whether the fire detection apparatus detects the fire of the burner head, whether cookware is placed on the burner head. By using such a gas cooktop including the control system, the gas cooktop automatically adjusts the fire to a minimum after a user removes a cookware, thus reducing fume in a kitchen and reducing gas consumption.

18 Claims, 3 Drawing Sheets

(52) U.S. Cl.
CPC ..... *F23N 2229/20* (2020.01); *F23N 2235/14* (2020.01); *F23N 2235/16* (2020.01)

(58) Field of Classification Search
CPC .. F24C 15/2021; F23N 1/005; F23N 2229/14; F23N 2229/16; F23N 2235/12; F23N 2235/14; F23N 2235/16; F23N 2229/04; F23N 2229/20; F23N 5/102; F23N 5/105; F23N 5/107; F23N 2900/05005; H05B 6/12; F23D 2208/10; F23D 14/60
USPC ..... 126/52, 299 R; 236/20 R; 340/584
See application file for complete search history.

(56) References Cited

U.S. PATENT DOCUMENTS 9,638,426 B2 * 5/2017 Golomb ..... F23N 5/082
10,366,591 B2 * 7/2019 Bucsa ..... H05B 6/062
10,820,750 B2 * 11/2020 Chin ..... A47J 37/0647
2002/0130190 A1 9/2002 Marbach
2005/0265423 A1 * 12/2005 Mahowald ..... H05B 6/687 374/121
2010/0304318 A1 * 12/2010 Muff ..... F23N 5/242 431/350
2011/0134413 A1 * 6/2011 Has ..... F24C 15/2021 356/51
2013/0153036 A1 * 6/2013 Young ..... F16K 37/0041 137/1
2013/0187781 A1 * 7/2013 Bach ..... F24C 15/2064 340/584
2016/0084506 A1 * 3/2016 Rickert ..... F24C 3/126 126/42
2017/0198920 A1 * 3/2017 Golomb ..... F23N 5/082
2017/0292711 A1 10/2017 Wang

FOREIGN PATENT DOCUMENTS

DE 102007058945 A1 6/2009
WO WO-2008031645 A1 * 3/2008 ..... F24C 3/126

* cited by examiner

GAS COOKTOP

CROSS-REFERENCES TO RELATED APPLICATIONS

This application is the U.S. National Stage of International Application No. PCT/IB2018/059295, filed Nov. 26, 2018, which designated the United States and has been published as International Publication No. WO 2019/130129 A1 and which claims the priority of Chinese Patent Application, Serial No. 201711454100.1, Dec. 27, 2017, pursuant to 35 U.S.C. 119(a)-(d).

BACKGROUND OF THE INVENTION

Technical Field

The present invention relates to the technical field of cooktops, and specifically, to a gas cooktop.

Related Art

When cooking food by using a gas cooktop, a user generally needs to remove cookware from the gas cooktop to clean the cookware after completing a process. To reduce fume in a kitchen, the user rotates a gas valve for small fire while removing a pot, and then adjusts the gas valve for big fire after cookware is placed on the gas cooktop again. However, the foregoing process is complex. Many users generally do not actively close a gas valve or rotate a gas valve for small fire, but instead keep fire of gas cooktops unchanged.

Therefore, a gas cooktop that can determine whether cookware is placed on a pot holder is needed, thus controlling fire of the gas cooktop, achieving automatic operation, and reducing energy consumption.

SUMMARY

A technical problem resolved in the present invention is how to enable a gas cooktop to determine whether cookware is placed on a pot holder, thus controlling fire of the gas cooktop, achieving automatic operation, and reducing energy consumption.

To resolve the foregoing technical problem, the present invention provides a gas cooktop, including: a cooktop body, where the cooktop body is provided with a burner head, and fire generated by the burner head is used for heating cookware placed on the burner head; and a control system, where the control system includes a fire detection apparatus and a control apparatus, and the control apparatus receives a signal of the fire detection apparatus to control the fire of the burner head. The fire detection apparatus is installed over the burner head and is aligned with the burner head, and the control apparatus determines, depending on whether the fire detection apparatus detects the fire of the burner head, whether cookware is placed on the burner head.

Optionally, the fire detection apparatus determines, by detecting whether the fire exists in a central area of the burner head, whether cookware is placed on the burner head.

Optionally, the fire detection apparatus is a thermal imager, configured to capture an infrared thermal image of the burner head. When the infrared thermal image captured by the thermal imager has temperature or a color corresponding to the fire in the central area of the burner head, the control apparatus determines that no cookware is placed on the burner head. When the infrared thermal image captured by the thermal imager does not have the temperature or the color corresponding to the fire in the central area of the burner head, the control apparatus determines that cookware is placed on the burner head.

Optionally, the fire detection apparatus is a fire sensor including an infrared receiver, configured to detect an infrared signal of the burner head. When the fire sensor detects that the infrared signal corresponding to the fire exists in the central area of the burner head, the control apparatus determines that no cookware is placed on the burner head. When the fire sensor does not detect that the infrared signal corresponding to the fire exists in the central area of the burner head, the control apparatus determines that cookware is placed on the burner head.

Optionally, the gas cooktop further includes: a gas pipeline, connected to the cooktop body and configured to supply gas to the cooktop body; and a gas valve, installed in the gas pipeline and rotating to control supply of the gas.

Optionally, the control system further includes a motor, where the motor is connected to the gas valve, and after the motor is turned on, the motor drives the gas valve to rotate to control the supply of the gas; and the control apparatus is connected to the motor and is configured to control turning on or off of the motor.

Optionally, when the control apparatus determines that no cookware is placed on the burner head, the control apparatus controls the motor to be turned on to drive the gas valve to rotate, so as to adjust the supply of the gas to a minimum.

Optionally, the control apparatus includes a timing unit, configured to time a time during which no cookware is placed on the burner head; and when a time result exceeds a preset time threshold, the control apparatus controls the motor to be turned on to drive the gas valve to rotate, so as to adjust the supply of the gas to a minimum.

Optionally, when the control apparatus determines that cookware is placed on the burner head, the control apparatus controls the motor to be turned on to drive the gas valve to rotate, so as to adjust the supply of the gas to a maximum.

Optionally, the control apparatus includes a memory unit, configured to store a last gas supply quantity; and when the control apparatus determines that cookware is placed on the burner head, the control apparatus controls the motor to be turned on to drive the gas valve to rotate, so as to recover the supply of the gas to the last gas supply quantity.

Optionally, the gas cooktop further includes a solenoid valve, in series with the gas valve and installed in the gas pipeline.

Optionally, the control apparatus is connected to the solenoid valve to control the solenoid valve to be opened or closed, so as to control the supply of the gas.

The present invention provides a method for controlling a gas cooktop according to the foregoing descriptions. When a fire detection apparatus detects fire of a burner head, a control apparatus determines that no cookware is placed on the burner head and controls the fire of the burner head to be adjusted to a minimum. When the fire detection apparatus does not detect the fire of the burner head, the control apparatus determines that cookware is placed on the burner head and controls the fire of the burner head to be adjusted to a maximum or recover to last fire.

Compared with the prior art, the technical solutions of the present invention have the following beneficial effects: The gas cooktop provided in the present invention includes the cooktop body and the control system, where the cooktop body is provided with the burner head, and the fire generated by the burner head is used for heating the cookware placed on the burner head; the control system includes the fire detection apparatus and the control apparatus, and the fire detection apparatus is installed over the burner head and is aligned with the burner head, and is configured to detect the fire of the burner head; and the control apparatus receives the signal of the fire detection apparatus and accordingly determines whether cookware is placed on the burner head, so as to control the fire of the burner head. When the fire detection apparatus does not detect the fire of the burner head, the control apparatus determines that cookware is placed on the burner head, and the control apparatus does not adjust the fire of the burner head. When the fire detection apparatus detects the fire of the burner head, the control apparatus determines that no cookware is placed on the burner head, and the control apparatus adjusts the fire of the burner head to a minimum. By using such a gas cooktop including the control system, the gas cooktop automatically adjusts the fire to a minimum after a user removes a pot, thus reducing fume in a kitchen and reducing gas consumption.

The present invention further provides a method for controlling a gas cooktop according to the foregoing descriptions. When a fire detection apparatus detects fire of a burner head, a control apparatus determines that no cookware is placed on the burner head and controls the fire of the burner head to be adjusted to a minimum. When the fire detection apparatus does not detect the fire of the burner head, the control apparatus determines that cookware is placed on the burner head and controls the fire of the burner head to be adjusted to a maximum or recover to last fire. By using such a method for controlling a gas cooktop, the gas cooktop automatically adjusts the fire to a minimum after a user removes a pot, thus reducing fume in a kitchen and reducing gas consumption.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

To make the foregoing objectives, features, and beneficial effects of the present invention more comprehensible, the following describes in detail the specific embodiments of the present invention with reference to the accompanying drawings.

Embodiment 1

Figure 1:
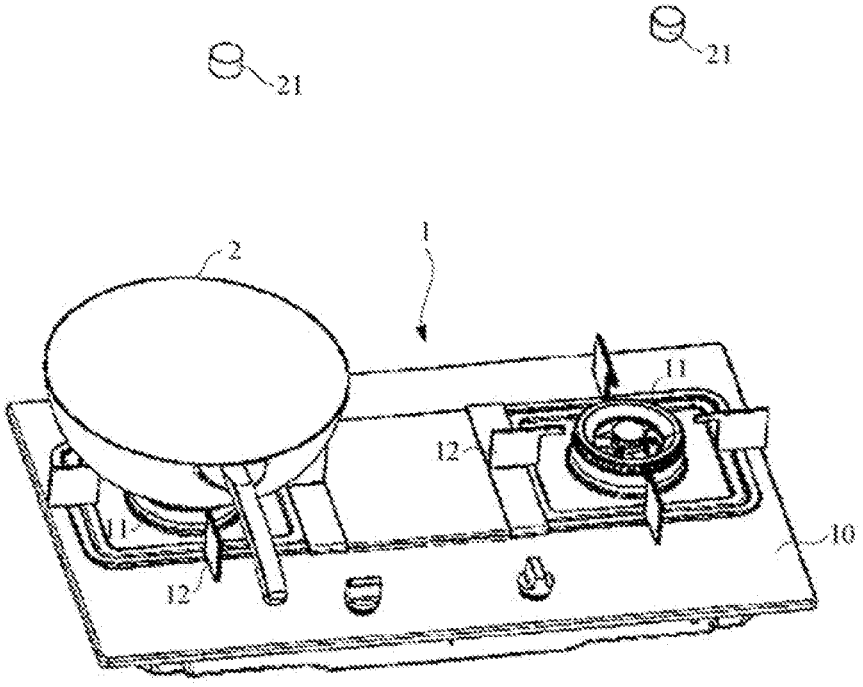
FIG. 1 is a first schematic three-dimensional diagram of a gas cooktop according to Embodiment 1 and Embodiment 2 of the present invention, where the figure shows a case in which cookware is placed on a pot holder.
Figure 2:
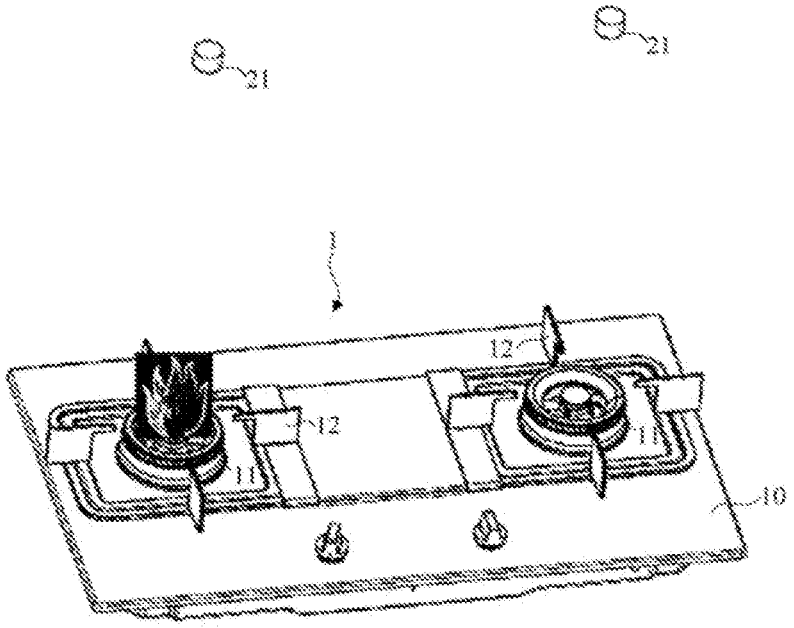
FIG. 2 is a second schematic three-dimensional diagram of the gas cooktop according to Embodiment 1 and Embodiment 2 of the present invention, where the figure shows a case in which no cookware is placed on a pot holder.
Figure 3:
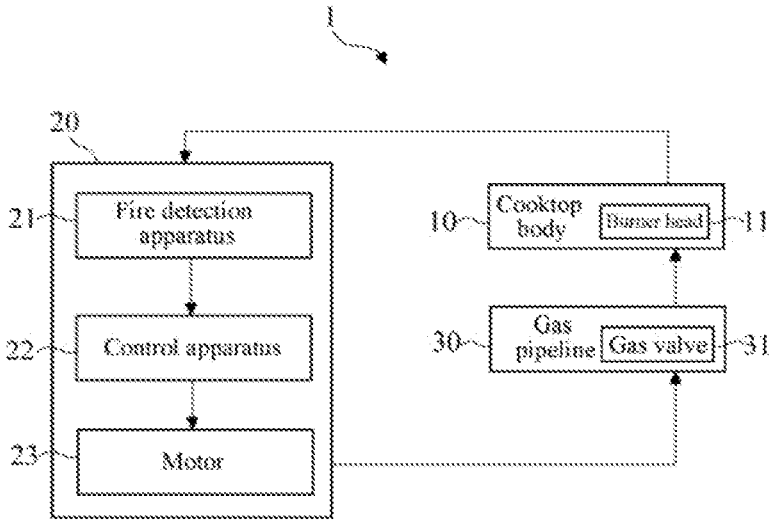
FIG. 3 is a first schematic diagram of a control module of the gas cooktop according to Embodiment 1 of the present invention, where the figure shows a control apparatus not including a timing unit and a memory unit.

Referring to FIG. 1 to FIG. 3, a gas cooktop 1 in this embodiment includes a cooktop body 10 and a control system 20. The cooktop body 10 is provided with a burner head 11. Cookware 2 is placed on a pot holder 12. Fire generated by the burner head 11 is used for heating the cookware 2 on the pot holder 12. The control system 20 includes a fire detection apparatus 21 and a control apparatus 22. The fire detection apparatus 21 is installed over the burner head 11 and is aligned with the burner head 11, and is configured to detect the fire of the burner head 11. That is, the fire detection apparatus 21 may be installed on a cooker hood, a cupboard, or a ceiling that is aligned with the burner head 11. The control apparatus 22 receives a signal of the fire detection apparatus 21 and accordingly determines whether cookware 2 is placed on the burner head 11, so as to control the fire of the burner head 11.

When the fire detection apparatus 21 does not detect the fire of the burner head 11, the control apparatus 22 determines that cookware 2 is placed on the burner head 11, and the control apparatus 22 does not adjust the fire of the burner head 11. When the fire detection apparatus 21 detects the fire of the burner head 11, no control apparatus 22 determines that the cookware 2 is placed on the burner head 11, and the control apparatus 22 adjusts the fire of the burner head 11 to a minimum. When the fire detection apparatus 21 does not detect the fire of the burner head 11 again, the control apparatus 22 determines that cookware 2 is placed on the burner head 11 again, and the control apparatus 22 controls the fire of the burner head 11 to be adjusted to a maximum or recover to last fire. By using such a gas cooktop 1 including the control system 20, the gas cooktop 1 automatically adjusts the fire to a minimum after a user removes a pot, thus reducing fume in a kitchen and reducing gas consumption.

After cookware 2 is placed on the pot holder 12, a part of the fire of the burner head 11 spurts from a periphery of the bottom of the cookware 2 when heating the cookware 2. To enable the control system 20 to accurately control the fire of the burner head 11 so that the fire of the burner head 11 will not be adjusted to a minimum when cookware 2 is placed on the burner head 11, the fire detection apparatus 21 determines, by detecting whether the fire exists in a central area of the burner head 11, whether cookware 2 is placed on the burner head 11.

Specifically, the fire detection apparatus 21 is optionally a thermal imager. The thermal imager is configured to capture an infrared thermal image of the burner head 11. The thermal imager transmits the captured infrared thermal image to the control apparatus 22. The control apparatus 22 determines, depending on whether the infrared thermal image has a color or temperature corresponding to the fire in the central area of the burner head 11, whether cookware 2 is placed on the burner head 11. When the infrared thermal image captured by the thermal imager has the color or the temperature corresponding to the fire in the central area of the burner head 11, the control apparatus 22 determines that the no cookware 2 is placed on the burner head 11. When the infrared thermal image captured by the thermal imager does not have the color or the temperature corresponding to the fire in the central area of the burner head 11, the control apparatus 22 determines that cookware 2 is placed on the burner head 11.

The fire detection apparatus 21 is not limited to the thermal imager, but may alternatively be a fire sensor including an infrared receiver. The fire sensor is configured to detect whether an infrared signal corresponding to the fire exists in the central area of the burner head 11, and transmit the signal to the control apparatus 22. When the fire sensor detects that the infrared signal corresponding to the fire exists in the central area of the burner head 11, the control apparatus 22 determines that no cookware 2 is placed on the burner head 11. When the fire sensor does not detect that the infrared signal corresponding to the fire exists in the central area of the burner head 11, the control apparatus 22 determines that cookware 2 is placed on the burner head 11.

Still referring to FIG. 3, the gas cooktop 1 further includes a gas pipeline 30 and a gas valve 31 installed in the gas pipeline 30. The gas pipeline 30 is connected to the cooktop body 10 and supplies gas to the cooktop body 10. The gas valve 31 rotates to control supply of the gas in the gas pipeline 30, thus controlling the fire of the burner head 11. The control system 20 starts to operate after the gas valve 31 is opened. That is, the fire detection apparatus 21 starts to detect the fire of the burner head 11 in real time. Otherwise, the control system 20 does not operate, and the fire detection apparatus 21 does not detect the fire.

The control system 20 further includes a motor 23. The motor 23 is connected to the gas valve 31. After the motor 23 is turned on, the motor 23 can drive the gas valve 31 to rotate to control the supply of the gas. The control apparatus 22 is connected to the motor 23. The control apparatus 22 determines, according to the signal of the fire detection apparatus 21, whether cookware 2 is placed on the burner head 11, and then controls turning on or off of the motor 23, thus adjusting the fire of the burner head 11.

When the control apparatus 22 determines that no cookware 2 is placed on the burner head 11, the control apparatus 22 controls the motor 23 to be turned on to drive the gas valve 31 to rotate, so as to adjust the supply of the gas to a minimum. In this way, the fire of the burner head 11 is also adjusted to a minimum. After the gas valve 31 rotates to a lowest position, the control apparatus 22 controls the motor 23 to stop operating.

Figure 4:
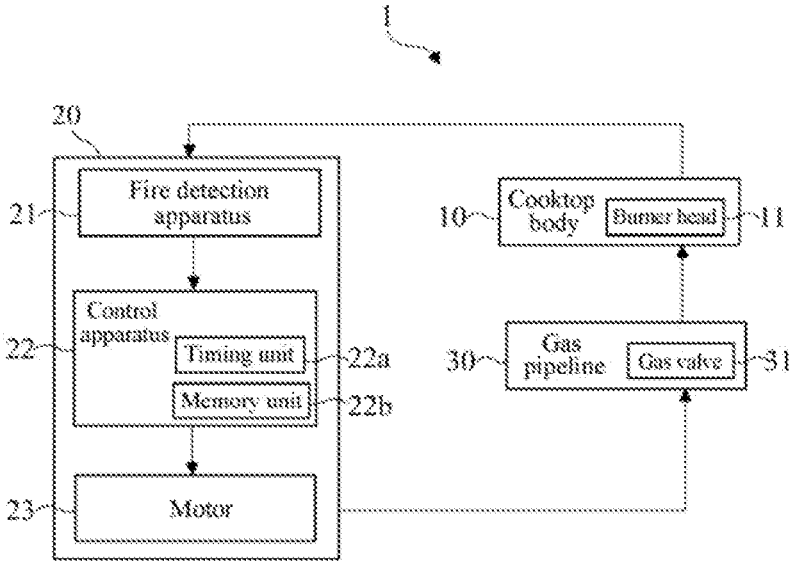
FIG. 4 is a second schematic diagram of a control module of the gas cooktop according to Embodiment 1 of the present invention, where the figure shows a control apparatus including a timing unit and a memory unit.

Referring to FIG. 4, the control apparatus 22 further includes a timing unit 22*a*. When the control apparatus 22 determines that no cookware 2 is placed on the burner head 11, the timing unit 22*a* starts to time a time during which no cookware 2 is placed on the burner head 11. If a time result exceeds a preset time threshold, the control apparatus 22 controls the motor 23 to be turned on to drive the gas valve 31 to rotate. Otherwise, the motor 23 is not turned on, and the original fire of the burner head 11 is maintained.

When the control apparatus 22 determines that cookware 2 is placed on the burner head 11, the control apparatus 22 controls the motor 23 to be turned on to drive the gas valve 31 to rotate, so as to adjust the supply of the gas to a maximum.

Still referring to FIG. 4, alternatively, the control apparatus 22 further includes a memory unit 22*b*. The memory unit 22*b* stores a last gas supply quantity, that is, a last position of the gas valve 31. When the control apparatus 22 determines that cookware 2 is placed on the burner head 11, the control apparatus 22 controls the motor 23 to be turned on to drive the gas valve 31 to rotate, so as to recover the gas valve 31 to the last position, that is, recover the supply of the gas to the last gas supply quantity. After the gas valve 31 is recovered to the original position, the control apparatus 22 controls the motor 23 to stop operating.

Embodiment 2

In Embodiment 1, the control apparatus 22 adjusts the amount of gas supply by controlling the motor 23 to adjust the position of the gas valve 31, thereby controlling the fire of the burner head 11.

Figure 5:
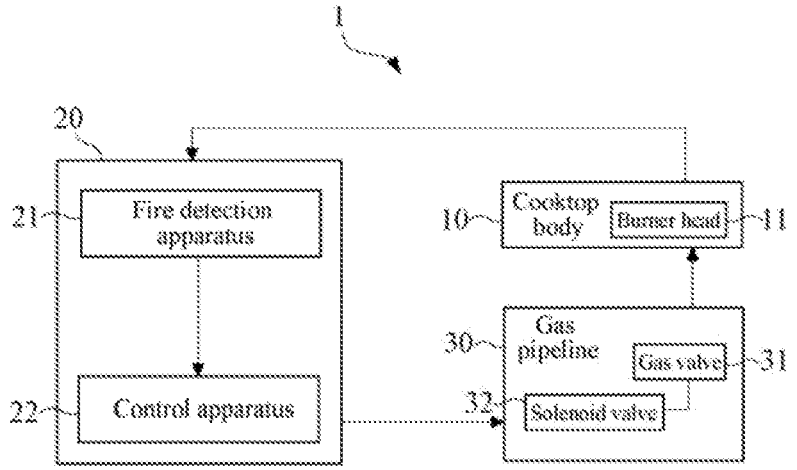
FIG. 5 is a schematic diagram of a control module of the gas cooktop according to Embodiment 2 of the present invention, where the figure shows a gas pipeline including a gas valve and a solenoid valve.

Referring to FIG. 5, in this embodiment, a gas cooktop 1 further includes a solenoid valve 32. The solenoid valve 32 is installed at a gas inlet end close to a gas pipeline 30. In addition, the solenoid valve 32 is in series with a gas valve 31. A control system 20 does not include a motor 23. Instead, a control apparatus 22 is directly connected to the solenoid valve 32. The control apparatus 22 controls opening or closing of the solenoid valve 32 according to a signal of a fire detection apparatus 21, thus controlling supply of gas to adjust fire of a burner head 11.

Specifically, when the control apparatus 22 determines that there is cookware 2 on the burner head 11, the control apparatus 22 controls the solenoid valve 32 to be opened. In this case, the gas can completely pass through the solenoid valve 32. In this way, the amount of gas supply completely depends on the position of the gas valve 31. When the control apparatus 22 determines that there is no cookware 2 on the burner head 11, when the solenoid valve 32 is closed, only a small quantity of gas is allowed to pass through the solenoid valve 32. In this way, the amount of gas supply in this case is very small regardless of the position of the gas valve 31, thus adjusting the fire of the burner head 11 to a minimum and reducing energy consumption. When the control apparatus 22 determines again that there is the cookware 2 on the burner head 11, the control apparatus 22 controls the solenoid valve 32 to be opened. Because the position of the gas valve 31 is not changed, in this case, a last gas supply quantity is recovered, and the fire of the burner head 11 is recovered to last fire.

By using a structure that the gas valve 31 is in series with the solenoid valve 32 in the gas pipeline 30, when the control system 20 does not include the motor 23 and a memory unit 22*b*, the gas cooktop 1 can also achieve functions of automatically adjusting the fire of the burner head 11 to a minimum after a user removes the pot, and automatically recovering the fire of the burner head 11 to the last fire after a pot is placed, thus reducing fume in a kitchen and reducing gas consumption.

The present invention is disclosed as above, but the present invention is not limited thereto. Any person skilled in the art may vary or modify the present invention without departing from the spirit or scope of the present invention. Therefore, the protection scope of the present invention is defined by the claims.

What is claimed is:

1. A gas cooktop, comprising:

a cooktop body including a burner head which when activated generates a fire for heating cookware placed on the burner head; and a control system including a fire detection apparatus installed over the burner head and aligned with the burner head, and a control apparatus configured to receive a signal of the fire detection apparatus and to control the fire of the burner head, said control apparatus configured to:

determine, depending on whether the signal indicates the fire detection apparatus detects the fire of the burner head, whether cookware is placed on the burner head;

control the fire of the burner head to be adjusted to a maximum when the control apparatus determines a presence of the cookware on the burner head in response to the signal of the fire detection apparatus;

control the fire of the burner head to be adjusted to a minimum when the control apparatus determines an absence of the cookware on the burner head in response to the signal of the fire detection apparatus; and control the fire of the burner head to be adjusted to recover to a last level of the fire of the burner head when, after the control apparatus determines the absence of the cookware on the burner head and adjusts the fire of the burner head to the minimum, the control apparatus determines the presence of the cookware on the burner head in response to the signal of the fire detection apparatus; and said fire detection apparatus is configured to determine, depending on whether the signal indicates the fire detection apparatus detects the fire of the burner head exists in a central area of the burner head, whether cookware is placed on the burner head.

2. The gas cooktop of claim 1, wherein the fire detection apparatus is a thermal imager configured to capture an infrared thermal image of the burner head, said control apparatus configured to determine the absence of cookware on the burner head when the infrared thermal image captured by the thermal imager has a temperature or a color corresponding to the fire in the central area of the burner head, and to determine the presence of cookware on the burner head when the infrared thermal image captured by the thermal imager does not have the temperature or the color corresponding to the fire in the central area of the burner head.

3. The gas cooktop of claim 1, wherein the fire detection apparatus is a fire sensor comprising an infrared receiver configured to detect an infrared signal of the burner head, said control apparatus configured to determine the absence of cookware on the burner head when the signal indicates the fire sensor detects that the infrared signal corresponding to the fire exists in the central area of the burner head, and to determine the presence of cookware on the burner head when the signal indicates the fire sensor does not detect that the infrared signal corresponding to the fire exists in the central area of the burner head.

4. The gas cooktop of claim 1, further comprising: a gas pipeline connected to the cooktop body and configured to supply gas to the cooktop body; and a gas valve installed in the gas pipeline and rotating to control supply of the gas.

5. The gas cooktop of claim 4, wherein the control system comprises a motor connected to the gas valve, and wherein the control apparatus is configured to, after the motor is turned on, drive the gas valve to rotate to control a supply of the gas, said control apparatus being connected to the motor and configured to control turning on or off of the motor.

6. The gas cooktop of claim 5, wherein, when the control apparatus determines the absence of cookware on the burner head, the control apparatus is configured to control the motor to be turned on to drive the gas valve to rotate, so as to adjust the supply of the gas to the minimum.

7. The gas cooktop of claim 6, wherein the control apparatus comprises a timing unit configured to time a time during which no cookware is placed on the burner head, said control apparatus configured to control the motor to be turned on to drive the gas valve to rotate, so as to adjust the supply of the gas to the minimum, when a time result exceeds a preset time threshold.

8. The gas cooktop of claim 7, wherein the control apparatus is configured to control the motor to be turned on to drive the gas valve to rotate, so as to adjust the supply of the gas to the maximum, when the control apparatus determines the presence of cookware on the burner head.

9. The gas cooktop of claim 5, wherein the control apparatus comprises a memory unit configured to store a last level of a gas supply quantity, said control apparatus configured to control the motor to be turned on to drive the gas valve to rotate, so as to recover the supply of the gas to the last level of the gas supply quantity, when determining the presence of cookware is placed on the burner head.

10. The gas cooktop of claim 4, further comprising a solenoid valve disposed in series with the gas valve and installed in the gas pipeline.

11. The gas cooktop of claim 10, wherein the control apparatus is connected to the solenoid valve and configured to control the solenoid valve to be opened or closed, so as to control the supply of the gas.

12. A method for controlling a gas cooktop, said method comprising:

monitoring a presence or absence of fire of a burner head of the gas cooktop by a fire detection apparatus installed over the burner head and aligned with the burner head;

controlling, by a control apparatus, the fire of the burner head to be adjusted to a minimum, when the control apparatus determines an absence of cookware on the burner head in response to the presence of the fire of the burner head as detected by the fire detection apparatus;

controlling, by the control apparatus, the fire of the burner head to be adjusted to a maximum level of fire of the burner head, when the control apparatus determines a presence of cookware on the burner head; and controlling, by the control apparatus, the fire of the burner head to be adjusted to recover to a last level of fire of the burner head when, after the control apparatus determines the absence of the cookware on the burner head and adjusts the fire of the burner head to the minimum, the control apparatus determines the presence of the cookware on the burner head in response to the absence of the fire of the burner head as detected by the fire detection apparatus, wherein the control fire detection apparatus is configured to determine, depending on whether the signal received from the fire detection apparatus indicates the fire detection apparatus detects the fire of the burner head exists only in a central area of the burner head, whether cookware is placed on the burner head.

13. A gas cooktop, comprising:

a cooktop body including a burner head which when activated generates a fire for heating cookware placed on the burner head; and a control system including a fire detection apparatus installed over the burner head and aligned with the burner head, and a control apparatus configured to receive a signal of the fire detection apparatus and to control the fire of the burner head, wherein the control apparatus is configured to:

store, in a memory unit, a last level of the fire of the burner head;

determine, depending on whether the signal indicates the fire detection apparatus detects the fire of the burner head, whether cookware is placed on the burner head;

control the fire of the burner head to be adjusted to a minimum when the control apparatus determines an absence of the cookware on the burner head in response to the signal of the fire detection apparatus; and control the fire of the burner head to be adjusted to recover to the last level of the fire of the burner head when, after the control apparatus determines the absence of the cookware on the burner head and adjusts the fire of the burner head to the minimum, the control apparatus determines the presence of the cookware on the burner head in response to the signal of the fire detection apparatus; and wherein the control fire detection apparatus is configured to determine, depending on whether the signal received from the fire detection apparatus indicates the fire detection apparatus detects the fire of the burner head exists only in a central area of the burner head, whether cookware is placed on the burner head.

14. The gas cooktop of claim 13, wherein the fire detection apparatus is a thermal imager configured to capture an infrared thermal image of the burner head, said control apparatus configured to determine the absence of cookware on the burner head when the infrared thermal image captured by the thermal imager has a temperature or a color corresponding to the fire only in the central area of the burner head, and to determine the presence of cookware on the burner head when the infrared thermal image captured by the thermal imager does not have the temperature or the color corresponding to the fire in the central area of the burner head.

15. The gas cooktop of claim 13, wherein the fire detection apparatus is a fire sensor comprising an infrared receiver configured to detect an infrared signal of the burner head, said control apparatus configured to determine the absence of cookware on the burner head when the signal indicates the fire sensor detects that the infrared signal corresponding to the fire exists only in the central area of the burner head, and to determine the presence of cookware on the burner head when the signal indicates the fire sensor does not detect that the infrared signal corresponding to the fire exists in the central area of the burner head.

16. The gas cooktop of claim 13, further comprising:

a gas pipeline connected to the cooktop body and configured to supply gas to the cooktop body; and a gas valve installed in the gas pipeline and rotating to control supply of the gas, wherein the control system comprises a motor connected to the gas valve, and wherein the control apparatus is configured to, after the motor is turned on, drive the gas valve to rotate to control a supply of the gas, said control apparatus being connected to the motor and configured to control turning on or off of the motor.

17. The gas cooktop of claim 16, wherein the control apparatus comprises a timing unit configured to time a time during which no cookware is placed on the burner head, said control apparatus configured to control the motor to be turned on to drive the gas valve to rotate, so as to adjust the supply of the gas to the minimum, when a time result exceeds a preset time threshold.

18. The gas cooktop of claim 13, further comprising:

a gas pipeline connected to the cooktop body and configured to supply gas to the cooktop body;

a gas valve installed in the gas pipeline and rotating to control supply of the gas; and a solenoid valve disposed in series with the gas valve and installed in the gas pipeline, wherein the control apparatus is connected to the solenoid valve and configured to control the solenoid valve to be opened or closed, so as to control the supply of the gas.

* * * * *